United States Patent [19]

Policella

[11] Patent Number: 4,747,331

[45] Date of Patent: May 31, 1988

[54] TRUE CUT BAGEL AND ROLL SLICER

[76] Inventor: Henry Policella, 108-A Oregon Ave., Bronxville, N.Y. 10708

[21] Appl. No.: 831

[22] Filed: Jan. 6, 1987

[51] Int. Cl.[4] ..... B26D 1/54; B26D 7/22; B27B 11/00; B27B 21/00

[52] U.S. Cl. ..... 83/762; 83/764; 83/765; 83/767; 83/768; 83/870

[58] Field of Search ..... 83/761, 762, 764, 765, 83/870, 767, 768, 829

[56] References Cited

U.S. PATENT DOCUMENTS

| | | | |
|---|---|---|---|
| 1,549,964 | 8/1925 | Downey | 83/761 |
| 1,953,137 | 4/1934 | Streckfuss | 83/762 |
| 2,172,538 | 9/1939 | Katzinger | 83/762 |
| 2,206,154 | 7/1940 | Bixler | 83/762 |
| 4,226,152 | 10/1980 | Bies | 83/764 |
| 4,249,445 | 2/1981 | Browning | 83/762 |
| 4,550,636 | 11/1985 | Josselson et al. | 83/762 |

FOREIGN PATENT DOCUMENTS

| | | | |
|---|---|---|---|
| 104001 | 7/1899 | Fed. Rep. of Germany | 83/762 |

*Primary Examiner*—E. R. Kazenske
*Assistant Examiner*—Scott A. Smith
*Attorney, Agent, or Firm*—Richard L. Miller

[57] ABSTRACT

A true cut bagel and roll slicer is provided and consist of a top hand grip integrally formed onto top of a housing with a pivotable front door to vertically receive a bagel/roll. A knife fits into an elongated vertical slot through the top hand grip and into the housing so as to cut the bagel/roll into two parts.

4 Claims, 1 Drawing Sheet

TRUE CUT BAGEL AND ROLL SLICER

BACKGROUND OF THE INVENTION

The instant invention relates generally to slicing machines and move specifically it relates to a true cut bagel and roll slicer.

Numerous slicing machines have been provided in the prior art that are adapted to cut various food products such as bread, cake, meat, cheese, etc.

While these units may be suitable for the particular purpose to which they address, they would not be suitable for the purpose of the present invention as hereafter described.

SUMMARY OF THE INVENTION

A primary object of the present invention is to provide a true cut bagel and roll slicer that will overcome the shortcomings of the prior art devices.

Another object is to provide a true cut bagel and roll slicer that will always evenly cut through a bagel or roll.

An additional object is to provide a true cut bagel and roll slicer that can be used by either a left handed or right handed person by simply adjusting the slicer to accommodate thereto.

A further object is to provide a true cut bagel and roll slicer that is simple and easy to use.

A still further object is to provide a true cut bagel and roll slicer that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
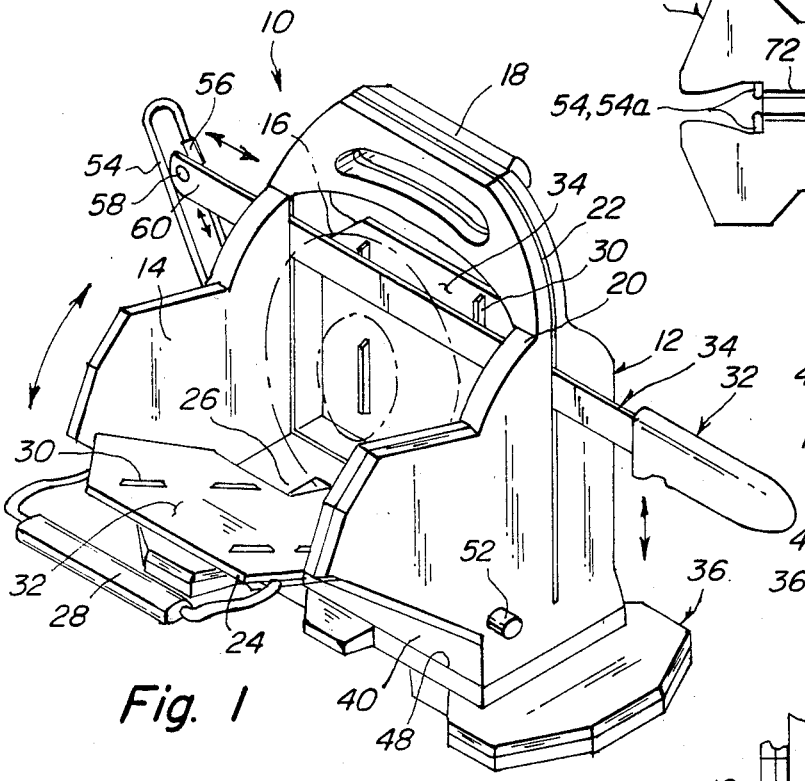
FIG. 1 is a perspective view of the invention.
Figure 2:
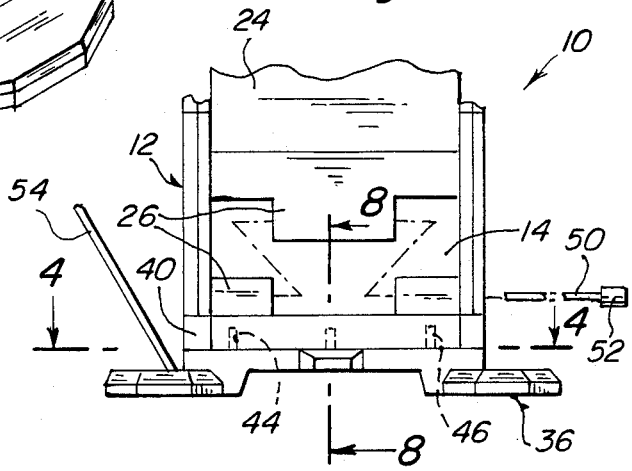
FIG. 2 is a front view with parts broken away and exploded therefrom.

Turning now descriptively to the drawings, in which like reference characters denote like elements throughout the several views, FIGS. 1 and 2 illustrates a true cut and roll slicer 10 that consists of a housing 12 that has an open front 14 and is of a size to vertically receive a bagel/roll 16 to be cut. A top hard grip 18 is integrally formed onto top 20 of the housing 12 and has an elongated vertical slot 22 extending into the housing. A door 24 that has a hinge 26 is pivotable at bottom edge to the open front 14 of the housing 12. A handle 28 extends upwardly from top of the door 24. A plurality of inwardly facing grip portions 30 are formed on inter or face 32 of the door 24 and interior face 34 of the housing 12 opposite the door so that when the door is closed the grip portions 30 will engage with the bagel/roll 16 and hold it in a vertical position to be cut. A knife 32 has an extended blade 34 fits into the elongated vertical slot 22 so as to cut the bagel/roll into two parts.

Figure 3:
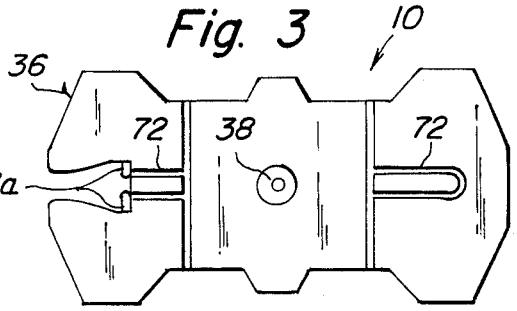
FIG. 3 is a bottom view of the base member.
Figure 8:
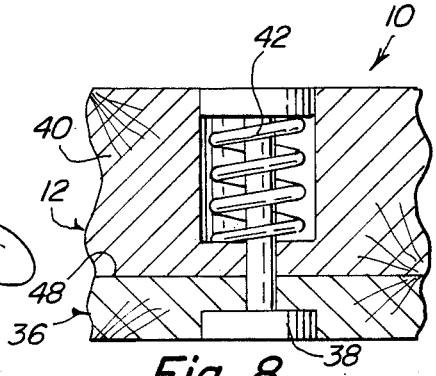
FIG. 8 is a enlarged cross sectional view taken along line 8—8 in FIG. 2.
Figure 4:
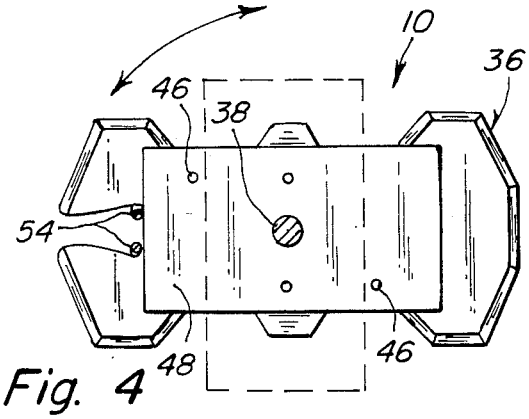
FIG. 4 is a cross sectional view taken along line 4—4 in FIG. 2 showing the base member being adjustable for right handed and left handed people using the invention.

As best shown in FIGS. 3, 4 and 8 the slicer 10 further includes a swivel base member 36 with a retaining post 38 mounted through center of the base member and center bottom 40 of the housing 12. A spring 42 is captivated onto the retaining post 38 to normally keep the base member 36 biased against the bottom 40 of the housing 12. The housing has a plurality of holes 44 in a platform and extending upwardly from bottom 40 of the housing. A plurality of pins 46 is provided in a matching pattern with the holes 44 and extend upwardly from top 48 of the base member 36, so as to properly mate with the holes in a right position and a left position when the base member 36 is swiveled left and right.

As best shown in FIG. 2 the slicer 10 contains an elongated shaft 50 that has an enlarged head 52 at one end. The shaft 50 is removably from the door hinge 26 so that the door 24 can be disassembled from the housing 12 for cleaning and the like.

A pivotable guide member 54 extends upwardly from the base member 36. A slide member 56 is pivotally affixed at 58 to tip 60 of the blade 34 to prevent the blade from leaving the elongated vertical slot 22 in the top hand grip 18 and the housing 12 when a person (not shown) uses the knife 32 to cut the bagel/roll 16 into two parts.

Figure 5:
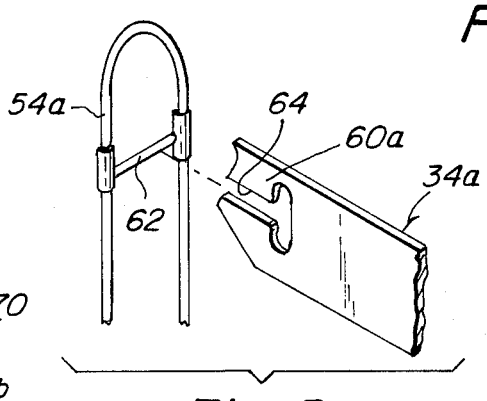
FIG. 5 is a perspective view with parts broken away of just the tip structure of a modified knife blade.

FIG. 5 shows a pivotable inverted elongated U-shaped guide member **54*a* extending upwardly from the base member 36. A cross bar member 62 is slidable on the guide member 54*a*. The knife blade 34*a* has a horizontal T-shaped slot 64 at tip 60*a* thereof to be receivable onto the cross bar member 62 to prevent the blade 34*a* from leaving the elongated vertical slot 22 in the top hand grip 18 and the housing 12 when the person uses the knife to cut the bagel/roll 16** into two parts.

Figure 6:
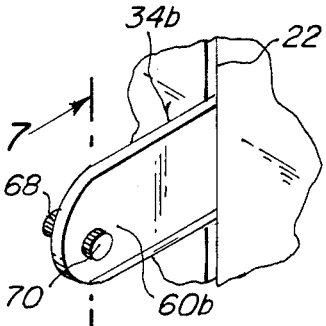
FIG. 6 is a perspective view with parts broken away of another tip structure of a modified knife blade.
Figure 7:
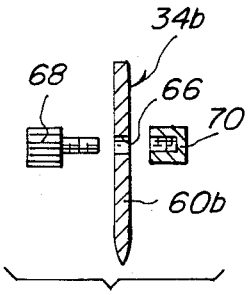
FIG. 7 is a cross sectional view taken on line 7—7 in FIG. 6.

FIGS. 6 and 7 shows the knife blade **34*a* that has a hole 66 through tip 60*b* thereof with a bolt 68 extending through the hole 66. A nut 70 is threadable onto the bolt 68 so as to prevent the blade 34*b* from leaving the elongated vertical slot 22 in the top hand grip 18 and the housing 12 when a person uses the knife to cut the bagel/roll 16** into two parts.

The slicer 10 as best shown in FIG. 3 further includes the base member 36 having a recess 72 at underside 74 thereof to store the guide member 54, **54*a*** when not in use.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A true cut bagel and roll slicer which comprises:

(a) a housing having an open front and being of a size to vertically receive a bagel/roll to be cut;

(b) a top hand grip integrally formed onto a top of said housing having an elongated vertical slot extending into said housing;

(c) a door pivotable at a bottom edge to close onto said open front of said housing;

(d) a handle extending upwardly from a top of said door;

(e) a plurality of inwardly facing grip portions formed on an interior face of said door and an interior face of said housing opposite said door so that when said door is closed said grip portions will engage with the bagel/roll and hold it in a vertical position to be cut;

(f) a knife having an extended blade to fit into said elongated vertical slot so as to cut the bagel/roll in two parts;

(g) a swivel base member supporting said housing;

(h) a pivotable guide member extending upwardly from one side of said member;

(i) a slide member pivotally affixed to one end of said blade restraining said end to said guide member and preventing said blade from leaving said elongated vertical slot in said top hand grip and said housing when a person uses said knife to cut the bagel/roll into two parts and a handle on an opposite end of said blade; and (j) means for rotating said swivel base member with respect to said housing when said knife is upwardly pivoted out of said slot such that said guide member can be positioned on the left or the right side of said hand grip whereby said handle of said knife is correspondingly selectively positioned on the right or left side to thereby accommodate right and left handed people.

2. A true cut bagel/roll slicer as recited in claim 1 wherein said means for rotating comprises:

(a) a retaining post mounted through a center of said base member and a center bottom of said housing;

(b) a spring captivated onto said retaining post to normally keep said base member biased against a bottom of said housing, (c) said housing having a plurality of holes being in a pattern and extending upwardly from a bottom of said housing; and (d) a plurality of pins being in a matching pattern with said holes, extending upwardly from a top of said base member so as to properly mate with said holes in a right position and a left position with said base member is swiveled left and right.

3. A true cut bagel & roll slicer as recited in claim 2 further comprising an elongated shaft having an enlarged head at one end of said shaft for pivoting said door to said housing and being removable so that said door can be disassembled from said housing for cleaning and the like.

4. A true cut bagel and roll slicer as recited in claim 1 further comprising said base member having a recess at an underside thereof to store said guide member when not to use.

* * * * *